US012269653B2

(12) United States Patent
Rosendall et al.

(10) Patent No.: US 12,269,653 B2
(45) Date of Patent: Apr. 8, 2025

(54) PRODUCT PACKAGE WITH INTERCHANGEABLE SLEEVES

(71) Applicant: MARS, INCORPORATED, McLean, VA (US)

(72) Inventors: Eric Rosendall, Lansing, MI (US); Jen Coniglio, Chicago, IL (US); Rich Funk, Park Ridge, IL (US)

(73) Assignee: Mars, Incorporated, McLean, VA (US)

( * ) Notice: Subject to any disclaimer, the term of this patent is extended or adjusted under 35 U.S.C. 154(b) by 26 days.

(21) Appl. No.: 17/784,577

(22) PCT Filed: Dec. 11, 2020

(86) PCT No.: PCT/US2020/064460
§ 371 (c)(1),
(2) Date: Jun. 10, 2022

(87) PCT Pub. No.: WO2021/119399
PCT Pub. Date: Jun. 17, 2021

(65) Prior Publication Data

US 2023/0002105 A1 Jan. 5, 2023

Related U.S. Application Data

(60) Provisional application No. 62/947,196, filed on Dec. 12, 2019.

(51) Int. Cl.
*B65D 5/38* (2006.01)
*B65B 5/02* (2006.01)
(Continued)

(52) U.S. Cl.
CPC ..... *B65D 5/38* (2013.01); *B65B 5/02* (2013.01); *B65B 5/04* (2013.01); *B65D 5/4216* (2013.01); *B65D 77/02* (2013.01)

(58) Field of Classification Search
CPC ..... B65D 5/38; B65D 5/503; B65D 5/5038; B65D 5/4216; B65D 50/046; B65D 77/02; B65D 2215/02
(Continued)

(56) References Cited

U.S. PATENT DOCUMENTS 2,132,957 A * 10/1938 Mahone ..... B65D 5/2004 229/122.34
D126,123 S 3/1941 Clemens
(Continued)

FOREIGN PATENT DOCUMENTS

EM 001161855-0003 11/2009
GB 2083937 A 3/1982

OTHER PUBLICATIONS

Exclusive to Festival Foods: Green and Gold Packers M&Ms. Online, published date Aug. 30, 2019. Retrieved on Apr. 20, 2021 from URL: https://www.festfoods.com/blog/exclusive-to-festival-foods-green-and-gold-packers-mms (Year: 2021).
(Continued)

*Primary Examiner* — Luan K Bui
(74) *Attorney, Agent, or Firm* — Bookoff McAndrews, PLLC

(57) ABSTRACT

Product packages and methods of reducing packaging waste arising from producing customized packages are disclosed. A plurality of trays are produced and a first batch of sleeves is produced corresponding to a first sleeve design, each sleeve of the first batch of sleeves being sized and shaped to be disposed about a respective one of the plurality of trays. Each sleeve of the first batch of sleeves is disposed about a respective one of the plurality trays to assemble a first plurality of packages. A second batch of sleeves is produced corresponding to a second sleeve design that is different from the first sleeve design, each sleeve of the second batch of sleeves being sized and shaped to be disposed about a
(Continued)

respective one of the plurality trays. Each sleeve of the second batch of sleeves is disposed about a respective one of the plurality of trays to assemble a second plurality of packages.

7 Claims, 5 Drawing Sheets

(51) Int. Cl.
*B65B 5/04* (2006.01)
*B65D 5/42* (2006.01)
*B65D 77/02* (2006.01)

(58) Field of Classification Search
USPC ..... 206/1.5, 468; 229/125.125
See application file for complete search history.

(56) References Cited

U.S. PATENT DOCUMENTS 2,430,609 A 11/1947 Reynolds
2,541,173 A * 2/1951 Moore ..... B65D 5/38 229/162.1
2,755,982 A * 7/1956 Lugt, Jr. ..... B65D 5/5021 229/162.1
3,371,843 A 3/1968 Hainey
3,395,849 A * 8/1968 Gillam ..... B65D 5/38 229/172
3,684,084 A * 8/1972 Kanzelberger ..... B65D 5/4204 229/131.1
3,905,543 A 9/1975 Randles
3,910,412 A * 10/1975 Vargo ..... B65D 5/5023 206/335
4,682,974 A 7/1987 Sun
5,143,210 A 9/1992 Warwick et al.
6,050,399 A * 4/2000 Pratt ..... B65D 71/50 206/161
6,223,912 B1 * 5/2001 Nerushai ..... A47F 1/12 40/538
6,880,313 B1 * 4/2005 Gessford ..... B65D 71/08 53/442
D576,873 S 9/2008 Kim
7,464,828 B1 * 12/2008 Unrau ..... A47K 17/00 220/8
D621,703 S 8/2010 Hageman
7,798,322 B2 * 9/2010 Wynalda, Jr. ..... G11B 33/0427 206/312
D720,614 S 1/2015 Kim et al.
9,738,412 B1 8/2017 Victor
10,407,215 B2 * 9/2019 Murray ..... B65D 5/0254
D883,802 S 5/2020 Meech et al.
D899,247 S 10/2020 Kilduff et al.
D910,439 S 2/2021 Kelly
D913,785 S 3/2021 Kelly
2001/0027993 A1 * 10/2001 Smith ..... B65D 5/48008 229/168
2003/0052040 A1 3/2003 Brener et al.
2007/0241016 A1 * 10/2007 Piczon ..... B65D 5/42 206/429
2007/0251983 A1 11/2007 Freeze
2008/0197043 A1 * 8/2008 Freeze ..... B65D 5/503 206/538
2011/0132779 A1 * 6/2011 Loughman ..... B65D 5/4204 229/125.125
2014/0262888 A1 * 9/2014 Wahrmund ..... B65G 57/26 206/386
2016/0114965 A1 4/2016 Huang
2019/0062023 A1 2/2019 Lantz et al.
2020/0140157 A1 5/2020 Pai
2021/0016939 A1 1/2021 Palmer et al.
2021/0171235 A1 * 6/2021 Boland ..... B65D 5/38

OTHER PUBLICATIONS

NBEADS Box Rectangle Burlywood Cardboard Bead Paper Gift Drawer Box for Jewellery Bracelet Necklace Crafts Birthday Christmas Festival Present Bangle Storage. Online, published date May 2, 2019. Retrieved on Apr. 20, 2021 from URL: https://www.amazon.eo.uk/NBEADS-Rectangle-Burly (Year: 2019).
XLPD 1 00Pcs/Lot 10 Sizes While/Black/Kraft Paper Gift Box Small/Large Kraft Paper Drawer Box, Paper Gift Cardboard Boxes White Color 8×8×4cm. Online, published date unknown. Retrieved on Apr. 20, 2021 from URL: https://www.amazon.com/XLPD-100Pcs-Drawer-Cardboard-8x8x4cm/dp/B07 JJGD5L7 (Year: 2021).
NBEADS Box Rectable Burlywood Cardboard Bead Paper Gift Drawer Box for Jewellery Bracelet Necklace Crafts Birthday Christmas Festival Present Bangle Storage. Online, published date May 2, 2019. Retrieved on Apr. 20, 2021 from URL: https://www.amazon.co.uk/NBEADS-Rectangle-Burly (Year: 2019).
XLPD 100Pcs/Lot 10 Sizes White/Black/Kraft Paper Gift Box Small/Large Kraft Paper Drawer Box, Paper Gift Cardboard Boxes White Color 8×8×4cm. Online, published date unknown. Retrieved on Apr. 20, 2021 from URL: https://www.amazon.com/XLPD-100Pcs-Drawer-Cardboard-8x8x4cm/dp/B07JJGD5L1 (Year: 2021).
The Design & Packaging Company, Sleeve Boxes. Online, published 2016, DNPackaging; URL: https://www.dnpackaging.com, 7 pages.

* cited by examiner

PRODUCT PACKAGE WITH INTERCHANGEABLE SLEEVES

TECHNICAL FIELD

The present disclosure relates to packaging and methods of producing packaging.

BACKGROUND

Sustainability is a high priority for consumer-packaged goods companies. Consumers enjoy seeing new and interesting packaging for products, however each update or change can result in wasted packaging components if too many components are made, particularly when packaging relates to time sensitive information or events. As such, companies need to balance the benefit of discounts as a result of volume production with the risk of wasting overstocked products with obsolete packaging.

For example, professional and collegiate sports games are scheduled almost daily during each respective season. Producing tailored product packages that reflect updated player and team statistics and other information after each game presents a steep resource demand as well as a high risk of producing too many or too few packages for the limited time period during which each batch of packages remains relevant.

As another example, product packaging can feature characters or themes from upcoming or recently released movies. If those products and corresponding packages have not been sold by the time the associated movies are no longer in theaters, the overstock may end up being discarded.

Additionally, seasonal and holiday-specific product packages are commonly used and are similarly at risk of being discarded at the end of each holiday or season. For example, demand for Thanksgiving themed packages drops off precipitously after the holiday passes, at which point any unsold Thanksgiving packages would be liquidated or discarded.

As such, there is a need for packaging assemblies that easily customizable while mitigating the risk of waste.

SUMMARY

One embodiment relates to a method of reducing packaging waste arising from producing customized packages. The method includes producing a plurality of trays and producing a first batch of sleeves corresponding to a first sleeve design, each sleeve of the first batch of sleeves being sized and shaped to be disposed about a respective one of the plurality of trays. The method further includes disposing each sleeve of the first batch of sleeves about a respective one of the plurality trays to assemble a first plurality of packages. The method includes producing a second batch of sleeves corresponding to a second sleeve design that is different from the first sleeve design, each sleeve of the second batch of sleeves being sized and shaped to be disposed about a respective one of the plurality trays. The method includes disposing each sleeve of the second batch of sleeves about a respective one of the plurality of trays to assemble a second plurality of packages.

Another embodiment relates to a package. The package includes a product, and a tray sized and shaped to be disposed within a plurality of sleeves of different sleeve designs and further defining a bowl portion sized and shaped to house the product for display. The package further includes a sleeve having a graphic on at least one outer surface.

Yet another embodiment relates to a mosaic of packages. The mosaic includes a plurality of trays housing a corresponding plurality of products. The mosaic further includes a first set of sleeves incorporating a first sleeve design, the first set of sleeves disposed about a first portion of the plurality of trays to form a first set of product packages. The first set of product packages is organized to form a mosaic design, and each of the plurality of trays have the same design.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive product packages and methods of producing such product packages. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
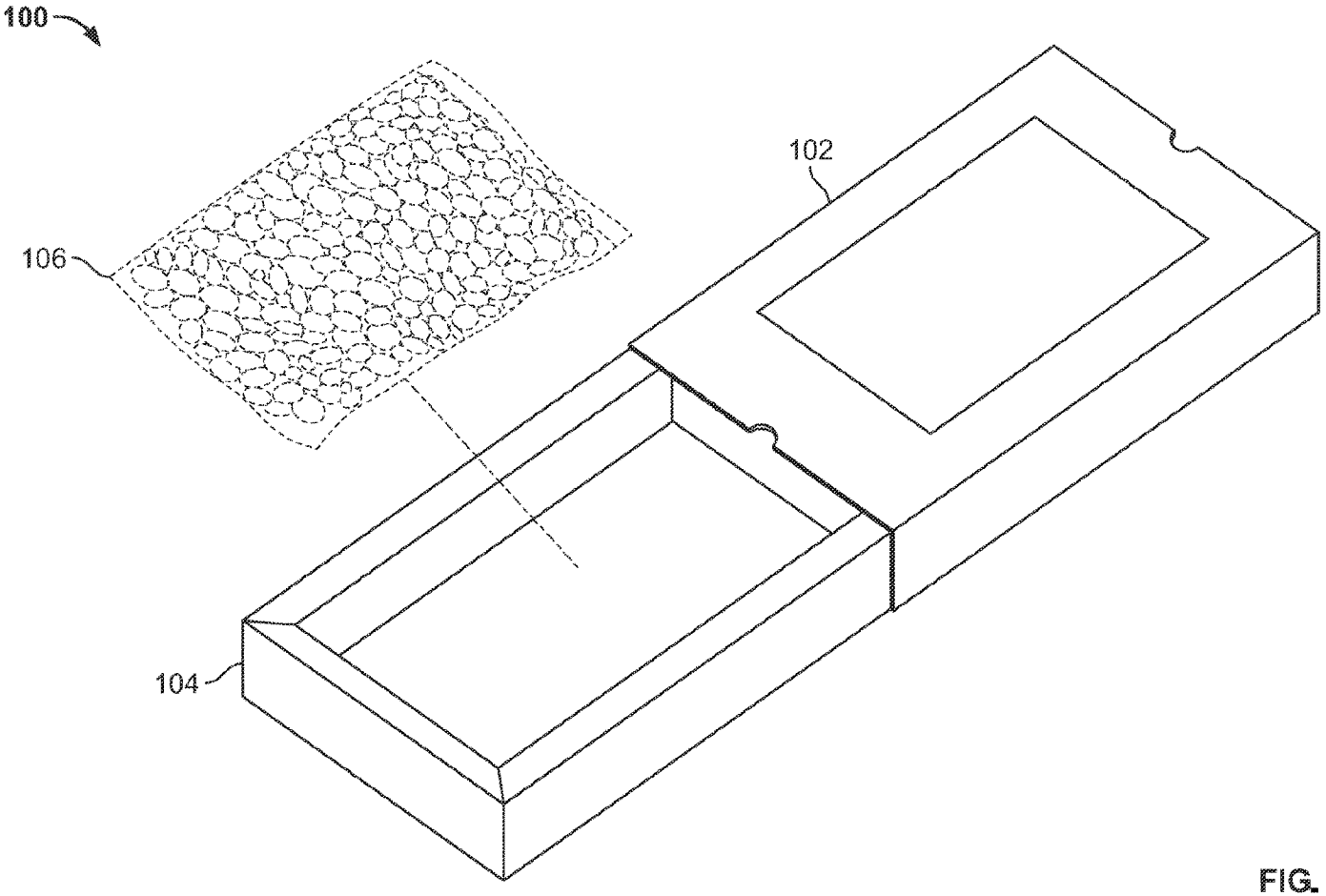
FIG. 1 shows a perspective exploded view of a product package, according to an example embodiment.
Figure 2:
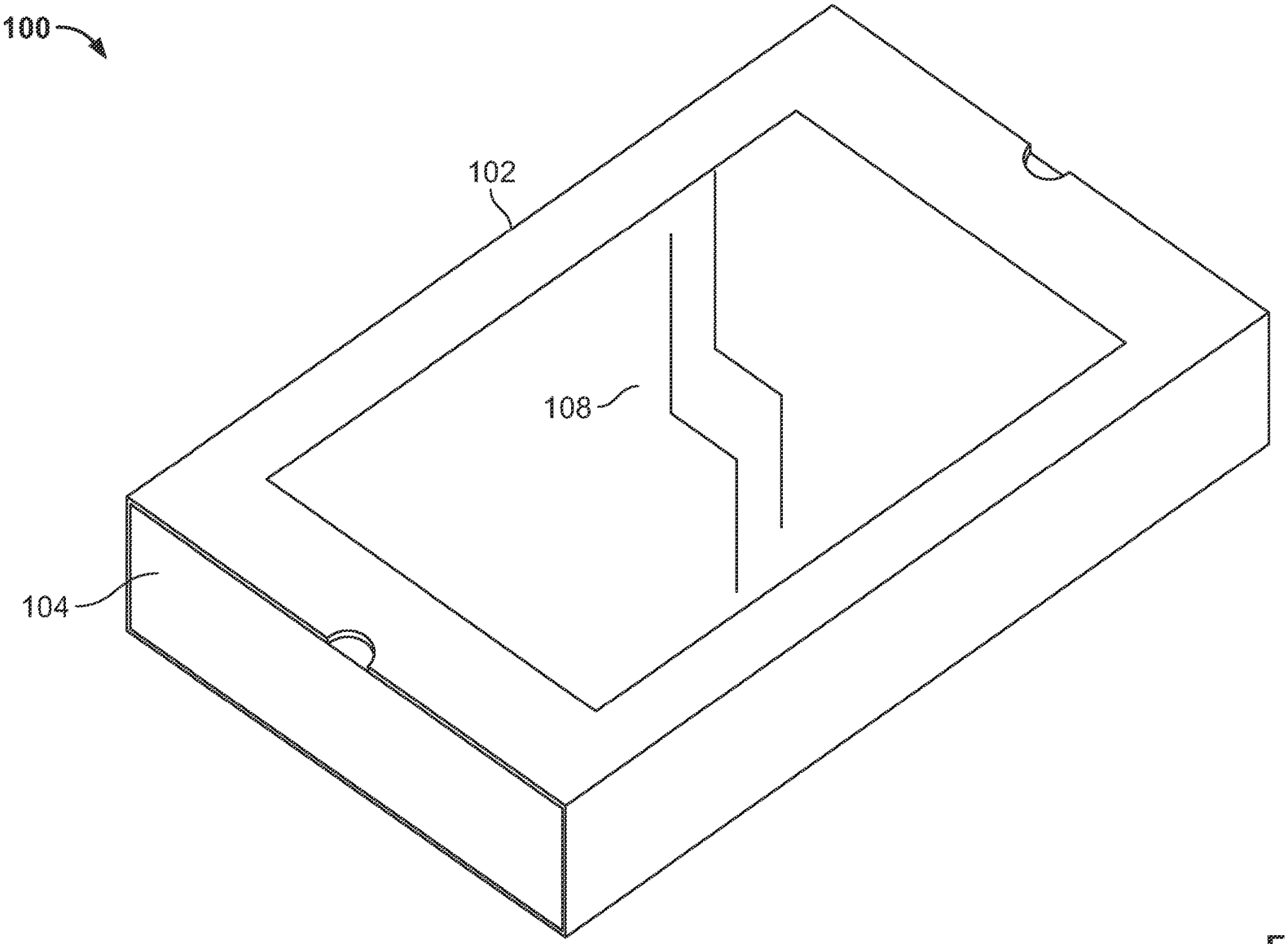
FIG. 2 shows a perspective assembled view of the product package of FIG. 1.

Referring to FIGS. 1 and 2, a product package 100 according to an example arrangement is shown. The product package 100 may be used to store and protect various types of consumer-packaged goods, including foodstuffs, pet food, housewares, clothing, among other products. In various arrangements, the product package 100 includes features that are visible to consumers when the product package 100 is fully assembled, as well as features that are visible on individual components of the product package 100 that consumers may access when the product package 100 is opened. In addition, as discussed in more detail below, multiple product packages 100 may be displayed together to form visual mosaic designs corresponding to pictures, symbols, or other visual images. Consistent throughout these arrangements of the product package 100, certain components of the product package 100 may be changed or updated and used with other components that remain unchanged, allowing for significant reductions in packaging waste, improved speed to market through the use of pre-manufactured as well as customized packaging components, and significant improvements to packaging flexibility overall.

The product package 100 is shown in an exploded view in FIG. 1 and an assembled configuration in FIG. 2. The product package 100 may include a sleeve 102, a tray 104, and a product 106. The product 106 may be any of a variety of good or goods as mentioned above such as snacks (e.g., pretzels, nuts, trail mix, chips, granola, etc.), confections (e.g., chocolates, gummy candies, hard candies, etc.), foodstuffs (e.g., rice, beans, prepared meals, sauces, spice mixes, etc.), medication (e.g., tablets, capsules, creams, etc.), pet food (e.g., wet food, dry food, treats, etc.). Here the product 106 is shown as a pouch of foodstuffs. In another example (not shown) the good or goods may be in direct contact with the tray without a pouch or enclosure around it.

The product 106 may be disposed in the tray 104 which may then be inserted into the sleeve 102 as shown in FIG. 2. As will be discussed below, the sleeve 102 is highly customizable and a common pool of trays 104 can be used to fill a wide variety of different sleeves 102. In addition, the sleeve 102 is generally the least expensive packaging component (i.e., compared to the tray 104 or the product 106) of the product package 100. As such, the risk of waste as a result of an overstock of highly customized or time-sensitive packaging will be limited to only low cost, overstocked sleeves 102 (i.e., as opposed to the number of overstock sleeves, trays, and product), in stark contrast to product packages known in art that would otherwise need to be thrown out entirely. In some arrangements, the product package 100 may further include an overwrap 108 (e.g., shrink wrap, cellophane, etc.) disposed about the outer surface of the product package 100 in the assembled configuration.

Figure 3:
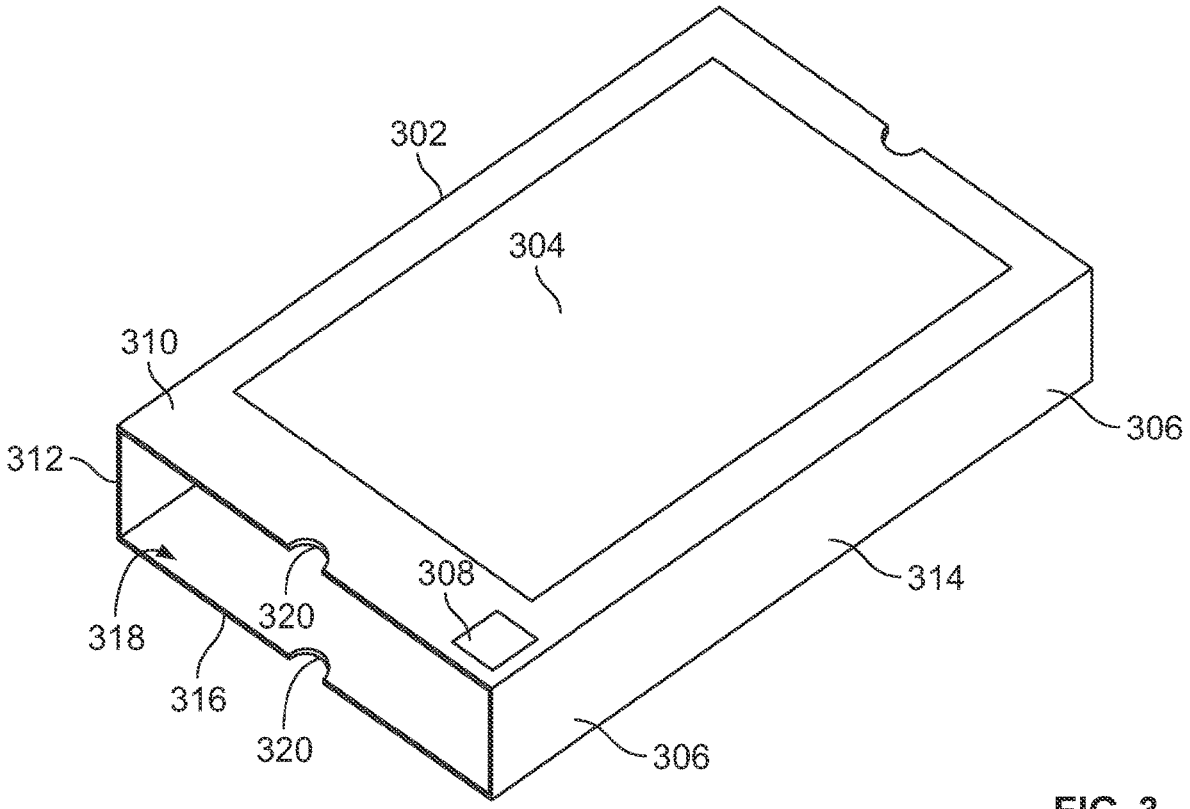
FIG. 3 shows a perspective view of a product package sleeve, according to an example embodiment.

Referring now to FIG. 3, a sleeve 302 is shown according to an example arrangement. The sleeve 302 may be formed out of any suitable materials such as paperboard (e.g., untreated, coated, laminated, etc.), plastics (e.g., petroleum-based, bio-based, etc.), metals (e.g., tin, copper, aluminum, alloys, etc.), or a combination of materials, some or all of which may be biodegradable, recyclable, or compostable. In the arrangement shown, the sleeve 302 includes a front panel 310, a left side panel 312, a right-side panel 314, and a back panel 316 that may collectively form a rectangular exterior shape and define an open interior pocket 318 that is open on top and bottom. In other arrangements, a top panel (not shown) is used such that the sleeve 302 defines a closed interior pocket (i.e., closed at the top by the top panel). The sleeve 302 may define various other exterior shapes in other arrangements, such as a square, shapes with rounded corners, irregular shapes, and so on. In some arrangements, the sleeve 302 may be cut from a sheet of paperboard, folded, and glued to form the rectangular shape shown in FIG. 3. In various arrangements, the sleeve 302 may be collapsible for greater storage efficiency or improved ease of transport before being filled with a tray. For example, with the embodiment shown in FIG. 3 where the sleeve 302 is rectangular with an open top and bottom, a panel (e.g., the front panel 310) may be translated laterally relative to an opposing panel (e.g., the back panel 316) until all four panels are substantially flat and parallel in a collapsed orientation that effectively closes the interior pocket 318. Sleeves 302 in the collapsed orientation can be stacked and stored for later use, where each sleeve 302 may be returned to an open orientation defining the interior pocket 318 that can receive a corresponding tray.

The sleeve 302 may include a variety of features that give rise to one or more graphics that may be visually accessible on exterior or interior surfaces of the sleeve 302. In various arrangements, the graphics may arise from printed features, embossed or debossed features, textured features, dyed features, transparent materials or cutout portions (e.g., so that the product 106 or portions of the tray 104 may be seen through the sleeve 302), or three-dimensional features that may be molded, cast, or 3D printed, and so on. The sleeve 302 may further include one or more cutouts 320 or other such features that allow a consumer to more easily remove a tray disposed within the pocket 318 (e.g., by pushing on the tray 104 at the cutout 320, then grasping and withdrawing the tray 104). In one example, the printing on the sleeve is done using digital printing.

The arrangement of the sleeve 302 shown in FIG. 3 may include a first graphic 304, a second graphic 306, and a code 308 pursuant to an overall sleeve design. In this arrangement, the sleeve design is such that the first graphic 304 and the code 308 are disposed on an outer surface of the front panel 310 of the sleeve 302, and the second graphic 306 is disposed on an outer surface of the right side panel 314. In other arrangements, various graphics and one or more codes 308 may be disposed on any surface of the sleeve 302 or the tray (e.g., tray 104). In some arrangements, one or more codes 308 or graphics are not visually accessible when the package 100 is assembled (e.g., as shown in FIG. 2). In such arrangements, the package must be opened (e.g., the sleeve 102 must be removed from the tray 104, or the product 106 must be removed from the tray 104) or the code 308 is otherwise initially obscured (e.g., by a sticker, scratch off layer, or so on). In addition, more or fewer graphics may be applied to more or fewer panels of the sleeve 302 in other arrangements, and further, graphics may also be disposed on one or more interior surfaces (i.e., in the pocket 318) of the sleeve 302. As discussed above, the first graphic 304 and the second graphic 306 may include any of various forms of visual information such as text, shapes, pictures, and so on that may be printed, embossed, dyed, or otherwise disposed on a surface of the sleeve 302. In some arrangements, either or both the first graphic 304 and second graphic 306 may provide a portion of one or more mosaic designs as discussed in more detail below. Graphics may also be disposed on an overwrap 108 that may provide, for example, standalone text or images, or may be superimposed with graphics disposed on the underlying sleeve 302. In some arrangements, the sleeve 302 may not include any graphics.

The code 308 may be a marker that corresponds to another piece of information or a location of information and may be presented in the form of a quick-read (QR) code, a bar code, an alphanumeric code, wireless tags (e.g., NFC, RFID, etc.) and so on. The code 308 may be read by a computing device (e.g., a mobile device such as a smartphone or tablet, a laptop with a scanning apparatus, and so on) or otherwise entered into a computing system to access corresponding information such as websites, videos, images, marketing information, product information, computing device applications (e.g., loyalty program apps, games, tools, augmented reality programs, etc.), and so on that may correspond to the product 106, its manufacturer, one or more graphics on the package, and so on. For example, a consumer may obtain an embodiment of the package 100 with the sleeve 302 having the code 308 embodied as a QR code configured to retrieve a website with a game relating to the product 106. The consumer may use a smartphone with a QR code reader to scan the code 308, which causes the smartphone to open a web browser displaying the website, allowing the consumer to play a game.

Figure 4:
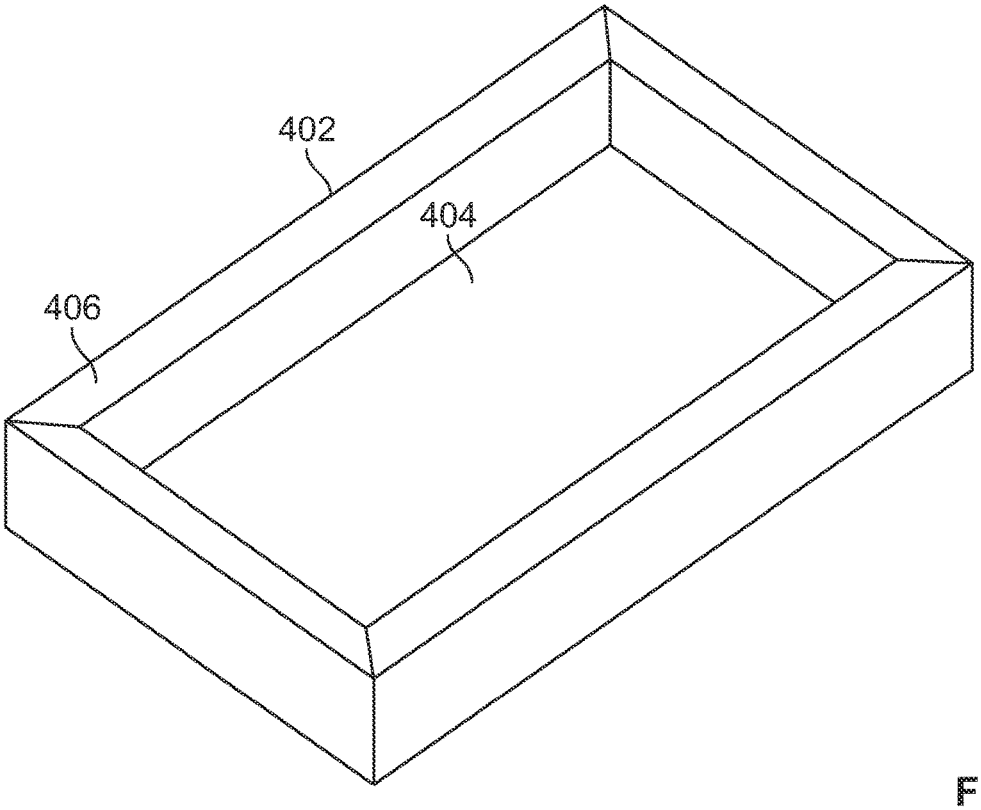
FIG. 4 shows a perspective view of a product package tray, according to an example embodiment.

Referring now to FIG. 4, a tray 402 is shown according to an example arrangement. The tray 402 may be shaped and sized such that it can be disposed within the interior pocket 318 of the sleeve 302. In various arrangements, the tray 402 may also include a variety of features that give rise to one or more graphics or codes that may be visually accessible on the tray 402, similar to the sleeve 302. In some such arrangements, tray 402 graphics may only be visible when the tray 402 has been removed from a corresponding sleeve 302. In some arrangements, the overall exterior shape of the tray 402 may be similar to the sleeve 302 (e.g., both rectangular, as shown in FIGS. 3 and 4). In other arrangements, the overall exterior shape of the tray 402 may be different than the sleeve 302 (e.g., a rectangular sleeve 302 with a tray 402 with rounded corners). The tray 402 may be sized to allow it to be disposed within the interior pocket 318 of the sleeve, but in some arrangements, the tray 402 may be sized such that one or more ends of the tray 402 protrudes out of one or more ends of the sleeve 302. In other arrangements, the tray 402 may be sized such that the entire tray 402 may be disposed within the pocket 318 or is otherwise flush with the edges of the sleeve 302 when disposed within the pocket 318 (e.g., as shown in FIG. 2).

The tray 402 may be formed of the same or similar materials as the sleeve 302. For example, both the tray 402 and sleeve 302 may be formed from the same type and thickness of paperboard. However, in other arrangements, one of the sleeve 302 and tray 402 is formed of a more robust composition of materials than the other. In some arrangements, one of the tray 402 and the sleeve 302 may be formed of different materials than the other (e.g., a metallic tray 402 with a paperboard sleeve 302). Alternatively, one of the tray 402 and the sleeve 302 may be formed with a thicker or denser composition of the same material as the other (e.g., a first thickness and a second thickness of paperboard, respectively). In some arrangements, the sleeve 302 may be formed of a more robust material than the tray 402, in anticipation of consumers retaining the sleeve 302 and disposing the tray 402 after consuming or using the product 106. Alternatively, the tray 402 may be formed of the more robust material than the sleeve 302, for example to improve the performance of the tray 402 as a display or serving device for the product 106.

The tray 402 may include a border portion 406 and a bowl portion 404 that may be shaped to house the product 106 and may operate as a serving dish or a display for the product 106 after the product package 100 is opened. The border portion 406 may be an outer portion about the outer perimeter of the tray 402 that defines edges of the bowl portion 404. The border portion 406 may be formed of a lightweight material and may further be formed in a hollow orientation for improved structural rigidity as well as reducing weight and amount of material used for construction. In some arrangements, the border portion 406 may be formed such that it includes a flat portion sized to protect product 106 disposed within the bowl portion, have one or more graphics displayed, or provide structural rigidity to the tray 402. In some arrangements, the border portion 406 slopes downward into the bowl portion 404 of the tray 402 in order to catch loose product 106 (e.g., when a consumer goes to pick up one or more pieces of product within the bowl portion 404) and redirect such loose product 106 back into the bowl portion 404. In such arrangements where the tray 402 includes a bowl portion 404, the tray 402 may be formed of food safe materials, particularly where the product 106 includes foodstuffs that may be in direct contact with the tray 402.

The arrangement shown in FIG. 4 only has a single bowl portion 404, however in various arrangements, the tray 402 may define multiple bowl portions with different shapes and sizes that may be customized and specific to particular products, and may further incorporate various dispensing mechanisms for the product (e.g., blisters, tear strips, and so on).

As such, the bowl portion 404 of the tray 402 conveniently eliminates the need for additional serving trays, bowls, dishes or the like, as consumers can simply remove a corresponding sleeve and use the tray 402 itself as a portable apparatus for serving or displaying product housed in the bowl portion 404. For example, in operation according to one arrangement, a consumer may select and purchases a fully assembled embodiment of the product package 100 from a retail store. The consumer may remove the overwrap 108, pull the tray 402 out from the interior pocket 318 of the sleeve 302 to access the product 106 (e.g., here, a pouch of foodstuffs). The consumer may remove the pouch and pours the product 106 within into the bowl portion 404 of the tray 402 for convenient access and consumption. At any point throughout, the consumer may scan the code 308 with a mobile device (e.g., a smartphone) to access media provided by the product manufacturer (e.g., a video).

Figure 5:
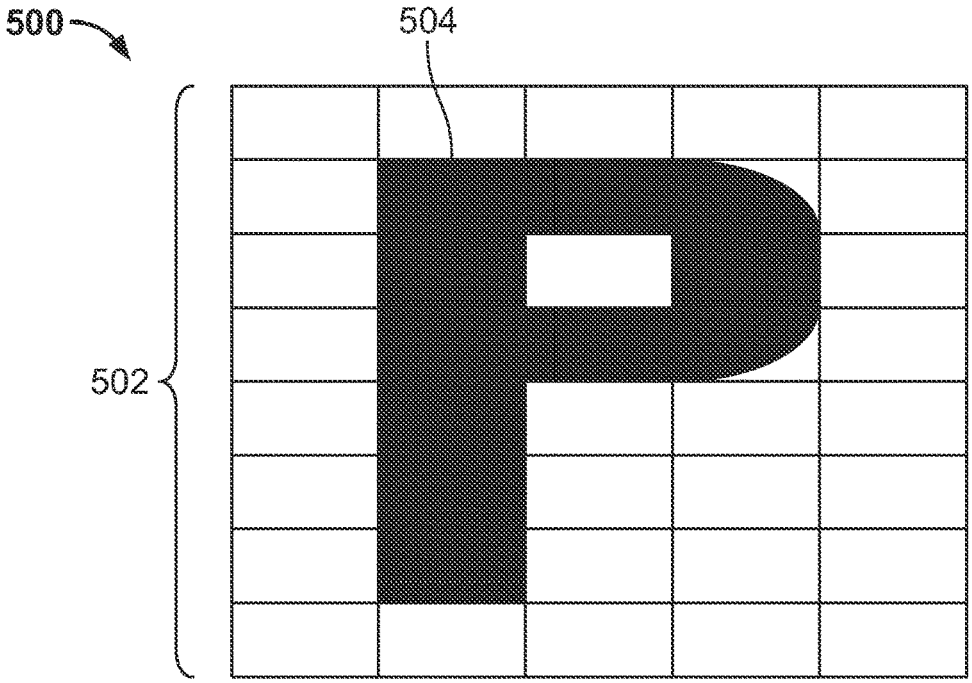
FIG. 5 shows a frontal view of a first mosaic design of product packages, according to an example embodiment.
Figure 6:
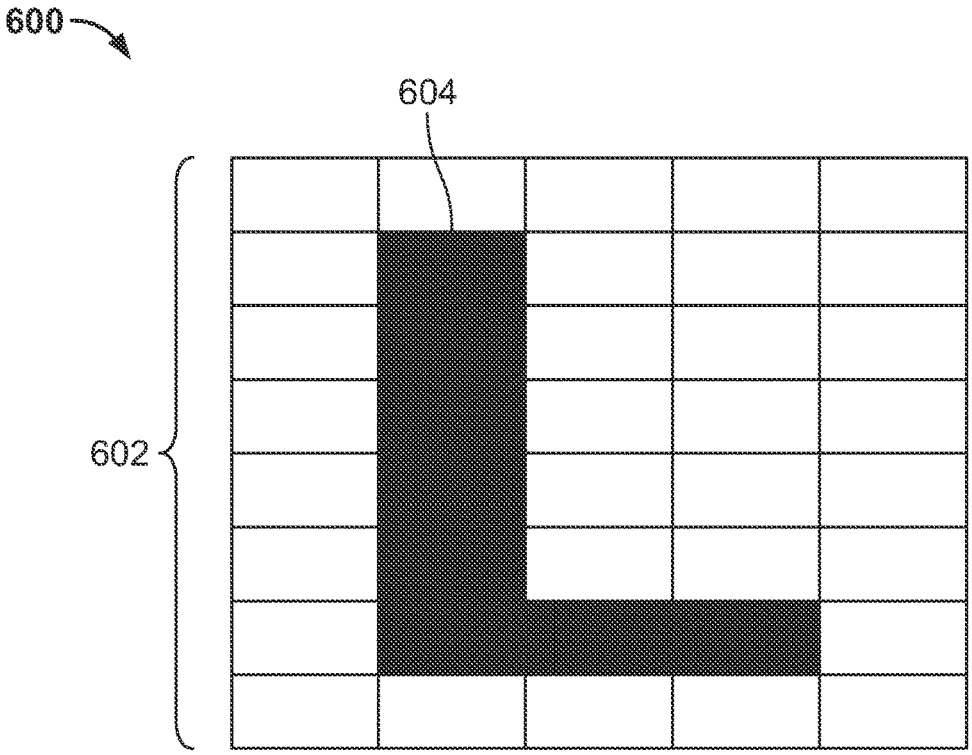
FIG. 6 shows a frontal view of a second mosaic design of product packages, according to an example embodiment.

Referring now to FIGS. 5 and 6, a first mosaic 500 and a second mosaic 600 are respectively shown according to example arrangements of product packages. Each of the mosaics 500, 600 may be constructed from a set of product packages (e.g., product package 100) that are organized to collectively form a visual design. For ease of this explanation, the first mosaic 500 is constructed to form a "P" from a first set of packages 502, and the second mosaic 600 is constructed to form an "L" from a second set of packages 602, although mosaics of similar, more, or less detail are also contemplated under this disclosure.

Each set of product packages 502, 602 may be designed to collectively form a respective mosaic 500, 600 as a result of the overall composition of the graphics disposed on the components of each product package. For example, the first mosaic 500 may be constructed from product packages with graphics disposed on one panel of each respective sleeve (e.g., the right side panel 314). In another arrangement, the graphics of the packages forming first mosaic may arise from images on the overwrap superimposed on underlying images on the sleeve.

As discussed above, the present disclosure provides for product packages that can be quickly adapted and customized by making changes to the sleeves. In some arrangements, a mosaic (e.g., the first mosaic 500) may be formed from packages assembled from a single batch of sleeves designed to create that particular mosaic. As such, for example, a retailer may receive a single batch of product packages that are already assembled into an intended mosaic, or may receive a single batch of product packages sufficient to allow the retailer to assemble the corresponding mosaic themselves.

In operation according to one arrangement relating to an athletics promotion, a first sleeve design is created, a first batch of sleeves is produced pursuant to the first sleeve design, and the first batch of sleeves assembled into product packages (e.g., 100) and then organized to form the first mosaic 500 in support of team P following their latest win. One week later, a second sleeve design is created, a second batch of sleeves is produced pursuant to the second sleeve design, and the second batch of sleeves is assembled into product packages to form the second mosaic 600 in support of team L following their most recent win. Consistent across the product packages of the first mosaic 500 and the second mosaic 600, the same trays and products may be used without any changes between the two mosaics. As such, trays and product may be produced and stored in bulk, while sleeves are customized and made in limited quantity.

Alternatively, in other arrangements, mosaics may be formed from product packages with sleeves made from several batches. For example, a first batch of product packages include a first batch of sleeves corresponding to one piece of the first mosaic, a second batch of product packages include a second batch of sleeves corresponding to a second piece of the first mosaic, and so on. Each batch may be released over time, and consumers may collect them until they are able to construct the intended mosaic. One or more visual components of each product package (e.g., a graphic on a sleeve, or the code 308) can provide mosaic assembly instructions.

Figure 7:
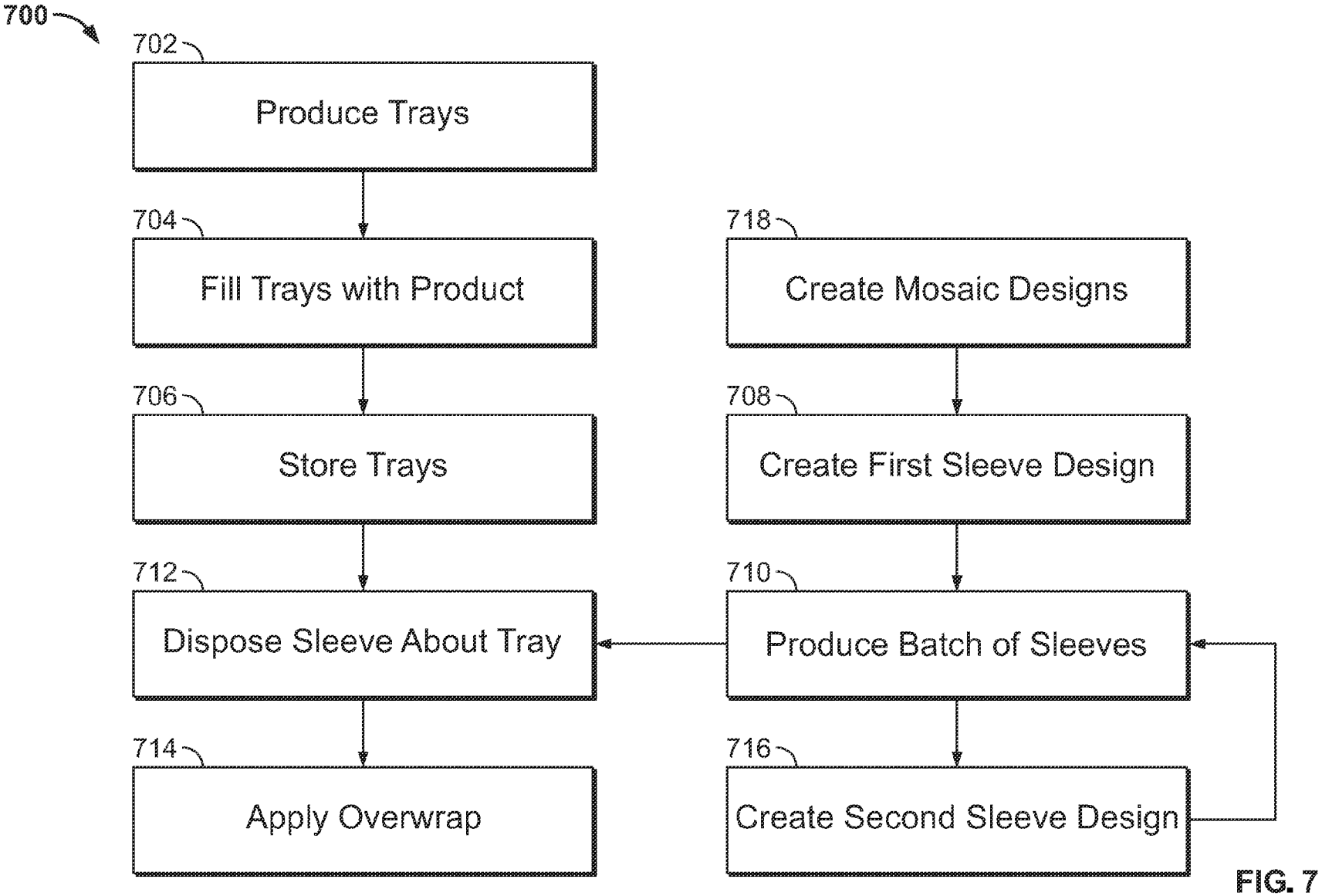
FIG. 7 illustrates a flow diagram showing a method of producing product packages, according to an example embodiment.

FIG. 7 illustrates a flow diagram showing a method 700 of producing product packages in accordance with example embodiments. In some embodiments, the volume of trays produced may be independent of the volume of sleeves produced, thereby allowing for greater manufacturing flexibility and efficiency as well as package customization as the same tray design can be used across multiple embodiments of sleeves.

At 702, a plurality of trays (e.g., tray 104, 402) is produced. Trays may be produced to house and protect product (e.g., 106) for the overall product package. In various arrangements, the trays may be produced with one or more bowl portions (e.g., bowl portion 404) that may be shaped and sized to allow for display or easy access to the product after the product package has been opened. Trays may be cut, folded, and glued, or may be blow molded, 3D printed, casted, and so on.

At 704, the plurality of trays is filled. The trays produced at 702 may be filled with product (e.g., product 106), for example foodstuffs, clothing, or other consumer packaged goods. In arrangements where the tray defines a bowl portion (e.g., bowl portion 404), the product may be disposed within the bowl portion of the tray. In some arrangements, trays may be filled with product that correspond to a sleeve design (e.g., corresponding colors, corresponding themes or motifs, and so on). In such arrangements, these trays may not be filled until a sleeve design is created (e.g., at 708 or 716, as described below). For example, a first set of trays may be filled with confectionery products having the team colors of one athletic team which is to be disposed in a sleeve having a first sleeve design incorporating those team colors, and a second set of trays may be filled with confectionery products having the team colors of a second athletic team which may be disposed in another sleeve having a second sleeve design incorporating the colors of the second team.

In some arrangements, the plurality of trays produced at 702 may be stored at 706. Trays may be filled before or after storage at 706. Storing the trays allows the product packaging manufacturer to produce an inventory of trays that may be used across various product packages with different sleeves, thereby cutting down on manufacturing time, reducing costs as a result of safely producing higher volumes of trays, and reducing potential waste as each tray can be used with various different sleeves. The trays may be stored until they are needed to fill a batch of sleeves.

At 708, a first sleeve design is created. The first sleeve design may include any of a variety of graphics and visually accessible information (e.g., images, pictures, text, codes, and so on) that may be disposed on one or more surfaces of a sleeve.

At 710, a batch of product package sleeves (e.g., sleeve 102, 302) corresponding to the first sleeve design is produced. The batch of sleeves may be produced by any means known in the art, for example by cutting, folding, and gluing paperboard. Graphics corresponding to the first sleeve design may be added to the sleeves by printing, embossing, debossing, dying, and so on. In one example, the printing on the product package sleeves is done using digital printing.

At 712, the batch of sleeves produced at 710 are disposed about at least some of the trays produced at 702 to assemble a first plurality of product packages. In some arrangements, the sleeves produced at 710 may be fully assembled such that each tray is inserted into an interior pocket (e.g., interior pocket 318) of a corresponding sleeve. In other arrangements, the sleeves produced at 710 are flat blanks that are disposed about a corresponding tray and coupled at terminal ends (e.g., by gluing terminal ends of a sleeve blank together).

In some arrangements, an overwrap (e.g., overwrap 108) is applied at 714. In some such arrangements, the overwrap may be transparent about the entire product package and offers additional protection to the packaging and product. In other such arrangements, the overwrap may include additional graphical features that overlay the sleeve produced at 710.

At 716, a second sleeve design is created. The second sleeve design may be different from the first sleeve design, and may influenced by an event (e.g., an athletic team winning a game, a new movie, etc.), new information (e.g., updated statistics), and so on. After some visual component of the sleeve is changed, a corresponding batch of sleeves may be produced at 710, disposed about a tray at 712 to create a second plurality of product packages, and optionally overwrapped at 714.

In arrangements where product packages are used to construct mosaic designs (e.g., mosaic 500, 600), mosaic designs are created at 718. Each mosaic design may be broken up into individual pieces to be disposed on exterior surfaces of product packages (e.g., right side panel 314 of the sleeve) across sleeve designs for one or more batches of sleeves. In some arrangements, each of the first sleeve design and the second sleeve design may correspond to an entire respective mosaic designed at 718. In other arrangements, each of the first sleeve design and the second sleeve design may only correspond to one or more pieces of a mosaic designed at 708.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only.

Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. A mosaic of packages, comprising:

a first set of product packages, comprising:

a first plurality of trays housing a corresponding first plurality of products;

a first plurality of sleeves configured to receive the first plurality of trays, each of the first plurality of sleeves configured to receive at least one of the first plurality of trays, each of the first plurality of sleeves including a plurality of panels that define an open interior pocket, wherein a subgroup of the first plurality of sleeves comprises sleeves incorporating a first graphic disposed on at least one panel; and wherein the subgroup of the first plurality of sleeves are arranged with the first plurality of sleeves so that the relative position of the first graphic of each of the subgroup of the first plurality of sleeves, in combination, form at least a first portion of a visual design or a completed visual design.

2. The mosaic of packages of claim 1, further comprising:

a second set of product packages, comprising:

a second plurality of trays housing a corresponding second plurality of products;

a second plurality of sleeves configured to receive the second plurality of trays, each of the second plurality of sleeves configured to receive at least one of the second plurality of trays, the second plurality of sleeves being arranged to form the second set of product packages, each of the second plurality of sleeves including a plurality of panels that define an open interior pocket, wherein each of the second plurality of sleeves includes a second graphic disposed on at least one panel;

wherein the second plurality of sleeves are arranged so that the second graphic of each of the second plurality of sleeves, in combination, form at least a second portion of the visual design.

3. The mosaic of packages of claim 2, wherein the first portion and the second portion in combination complete the visual design.

4. The mosaic of packages of claim 2, wherein the first graphic is different from the second graphic.

5. The mosaic of packages of claim 1, wherein the first set of product packages includes a code disposed on at least one surface of at least one of the first plurality of sleeves or the first plurality of trays.

6. The mosaic of packages of claim 1, wherein each of the first plurality of trays includes a bowl portion, the bowl portion sized and shaped to house a respective product of the corresponding first plurality of products.

7. The mosaic of packages of claim 1, wherein the visual design and/or the completed visual design are associated with an athletic event.

* * * * *